US005575538A

United States Patent [19]

Gilbert et al.

[11] Patent Number: 5,575,538

[45] Date of Patent: Nov. 19, 1996

[54] ROCK SAW WITH CENTERLINE CONVEYOR ASSEMBLY AND METHOD OF DIGGING A NARROW TRENCH

[75] Inventors: Jerry F. Gilbert, Southlake; Jack D. Smith, The Colony, both of Tex.

[73] Assignee: Astec Industries, Inc., Chattanooga, Tenn.

[21] Appl. No.: 457,991

[22] Filed: Jun. 1, 1995

[51] Int. Cl.[6] ..... E01C 23/09; E02F 5/08

[52] U.S. Cl. ..... 299/39.2; 37/96; 299/39.3

[58] Field of Search ..... 299/39.2, 39.3, 299/64; 37/94, 95, 96, 359; 404/91

[56] References Cited

U.S. PATENT DOCUMENTS

| | | | |
|---|---|---|---|
| 4,193,636 | 3/1980 | Jakob | 299/39.2 |
| 4,755,001 | 7/1988 | Gilbert | 299/39.8 |
| 5,015,120 | 5/1991 | Brock et al. | 404/108 |
| 5,070,632 | 12/1991 | Gilbert | 37/90 |
| 5,092,657 | 3/1992 | Bryan, Jr. | 299/1.1 |
| 5,228,220 | 7/1993 | Bryan, Jr. | 37/364 |
| 5,381,616 | 1/1995 | Disney | 37/94 |
| 5,441,361 | 8/1995 | Campbell | 404/91 X |

FOREIGN PATENT DOCUMENTS

| | | | |
|---|---|---|---|
| 87361 | 8/1983 | European Pat. Off. | 37/96 |
| 9010752 | 9/1990 | WIPO | 404/91 |

OTHER PUBLICATIONS

Trencor, Inc., *Model 860B Specification* (3 pages), undated.

*Welsh Water Marketing*, Bruff Brochure (10 pages), undated.

*Primary Examiner*—David J. Bagnell

*Attorney, Agent, or Firm*—Nilles & Nilles, S.C.

[57] ABSTRACT

A rock saw has a cutting wheel and a conveyor assembly capable of retrieving automatically essentially all materials excavated by the cutting wheel and of discharging the retrieved materials into an adjacent truck or the like. The conveyor assembly includes a loading conveyor which is movable from a raised transport position to a lowered operative position. When in its operative position, an inlet end of the loading conveyor is positioned on the ground in a discharge region of the cutting wheel and is biased into engagement with the ground so as not to bounce up and down in operation but so as to ride over rocks and other obstructions without damaging the conveyor. The cutting wheel is both pivotable and slidable with respect to the vehicle mainframe so as to be capable of cutting trenches of radically different depths while still assuring retrieval of essentially all excavated materials by the loading conveyor.

17 Claims, 7 Drawing Sheets

ROCK SAW WITH CENTERLINE CONVEYOR ASSEMBLY AND METHOD OF DIGGING A NARROW TRENCH

BACKGROUND OF THE INVENTION

1. Field of the Invention

The invention relates to excavating machines and, more particularly, relates to a rock saw having a rotary cutting wheel and a conveyor assembly capable of conveying all excavated materials from the cutting wheel to a truck.

2. Discussion of the Related Art

It is often necessary to dig relatively narrow trenches (on the order of 3" to 2'), for receiving television cables, fiber optic cables, etc., through packed earth, asphalt, concrete, or even solid rock—materials too hard to be excavated by traditional chain type trenchers. Rock saws have proven to be ideally suited for this task. The typical rock saw includes a self-propelled chassis having a rock saw assembly extending from the rear end thereof which cuts a trench in the ground as the chassis is propelled forwardly. The rock saw assembly includes a hydrostatically powered carbide-tipped rotary cutting wheel which cuts through rock or other hard materials and throws excavated materials to the front of the cutting wheel. Rock saws of this type are disclosed in a brochure published by Bruff Manufacturing Limited, Worcestershire, England (the Bruff brochure) and in U.S. Pat. No. 5,381,616 to Disney. Similar rock saws are disclosed in Martin U.S. Pat. No. 4,542,940 and Martin U.S. Pat. No. 4,640,551.

All previously-known rock saws are incapable of conveying excavated materials away from the machine. The materials simply accumulate in front of and beside the cutting wheel such that, after trenching is complete, excavated materials are piled to either side of the trench. Discharging materials in this manner traditionally did not present a serious problem because excavated materials were simply used as backfill and thus need not be retrieved. However, government regulations and/or industrial requirements now frequently prohibit the use of the excavated materials for backfill. The loose excavated materials therefore must be retrieved and removed from the work site after the trenching operation is complete. This retrieval and removal are labor intensive and expensive. Moreover, if a "clean" trench, i.e., one which must be free of loose materials, is required, piling excavated materials beside the trench inevitably leads to some of the materials sliding back down into the trench either immediately after trenching or during the material retrieval process. In either case, loose materials must be cleaned out of the trench—usually manually—before the cable or pipeline can be laid.

The aforementioned problems could be remedied by discharging excavated materials from the cutting wheel directly onto a conveyor assembly. Other types of digging instruments such as chain trenchers have this capability because the digging implement also is capable of delivering materials to a laterally-extending conveyor which in turn delivers materials to a discharge conveyor assembly. However, rock saws merely throw excavated materials away from the cutting wheel rather than conveying them away from the trench and thus are poorly suited for use with traditional discharge conveyor assemblies, the inlet ends of which typically are not located close enough to the rock saw to receive materials thrown by the cutting wheel. Complete retrieval of essentially all materials excavated by a rock saw would require that the inlet end of the conveyor assembly ride on the ground in an excavated materials discharge region located immediately in front of the cutting wheel. The ideal conveyor assembly and rock saw assembly should also be versatile enough to assure material retrieval even after marked changes in trench depth. No previously known conveyor assembly or rock saw assembly has these capabilities.

OBJECTS AND SUMMARY OF THE INVENTION

It is therefore an object of the invention to provide a rock saw having a cutting wheel and a conveyor assembly capable of retrieving automatically essentially all materials excavated by the cutting wheel and of discharging the retrieved material into an adjacent truck or the like.

Another object of the invention is to provide a rock saw having the characteristics discussed above and the conveyor assembly and cutting wheel of which cooperate with one another so as to be capable of cutting trenches of radically different depths while still assuring retrieval of essentially all excavated materials.

Yet another object of the invention is to provide a rock saw having one or more of the characteristics discussed above and the conveyor assembly and cutting wheel of which are raiseable from a lowered operative position to a raised transport position.

In accordance with a first aspect of the invention, these objects of the invention are achieved by providing an excavating machine comprising a portable chassis, a frame assembly mounted on the chassis and extending longitudinally with respect to the chassis, and rock saw and conveyor assemblies mounted on the frame assembly. The rock saw assembly is mounted on the end portion of the frame assembly and comprises a rotary cutting wheel which is relatively narrow when compared to the frame assembly. In use, the rock saw assembly is operable to dig a trench and to discharge materials into a discharge region located longitudinally adjacent the cutting wheel. The loading conveyor is mounted on the frame assembly and has an inlet end movable from a transport position in which the inlet end is located above the ground to an operative position in which the inlet end rides on the ground in the discharge region.

Preferably, in order to facilitate movement from its operative to its transport position, the loading conveyor is pivotally mounted on the frame assembly at a pivot axis located longitudinally between the inlet end and the discharge end. An actuator is mounted on the frame assembly, is connected to the loading conveyor at a location between the inlet and discharge ends, and selectively pivots the loading conveyor about the pivot axis, thereby raising and lowering the inlet end.

In order to maintain the desired relationship between the rock saw assembly and the loading conveyor, a mast is mounted on the frame assembly, and a carriage is mounted on the mast for rectilinear movement with respect thereto and receives the rock saw assembly. The rock saw assembly is pivotally mounted on the carriage. Preferably, the mast comprises a pair of laterally spaced T-shaped rails and the carriage comprises a pair of laterally spaced C-shaped members slidably mounted on the T-shaped rails.

Yet another object of the invention is to provide a rock saw having a loading conveyor which is operable as discussed above and the inlet end of which is biased into engagement with the ground so as not to bounce up and down in operation but so as to ride over rocks and other obstructions without damaging the conveyor.

In accordance with this aspect of the invention, the actuator comprises a hydraulic cylinder, and a pressure compensated hydraulic circuit actuates the hydraulic cylinder to apply a designated downward biasing force to the inlet end of the loading conveyor when the inlet end is in the operative position. The hydraulic circuit preferably includes (1) a first circuit portion operable to supply a first pressure to a first end of the cylinder so as to lift the inlet end of the loading conveyor into the transport position and (2) a second circuit portion operable to supply a second pressure to a second end of the cylinder so as to hold the inlet end of the loading conveyor in the operative position, the second pressure being substantially less than the first pressure.

Still another object of the invention is to provide a method of digging a narrow trench in a hard or compacted surface which includes automatically retrieving essentially all excavated materials to permit their conveyance away from the work site.

In accordance with still another aspect of the invention, this object is achieved by lowering an inlet end of a loading conveyor from a raised transport position to a lowered operative position in which the inlet end rides on the ground at a location closely adjacent and longitudinally in front of a rotary cutting wheel of a rock saw assembly, the loading conveyor and the rock saw assembly being mounted on a frame assembly. Subsequent steps include rotating the cutting wheel to dig the trench, then discharging excavated materials directly from the cutting wheel onto the inlet end of the loading conveyor, and then conveying the excavated materials away from the rock saw assembly using the loading conveyor.

These and other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Résumé

Figure 1:
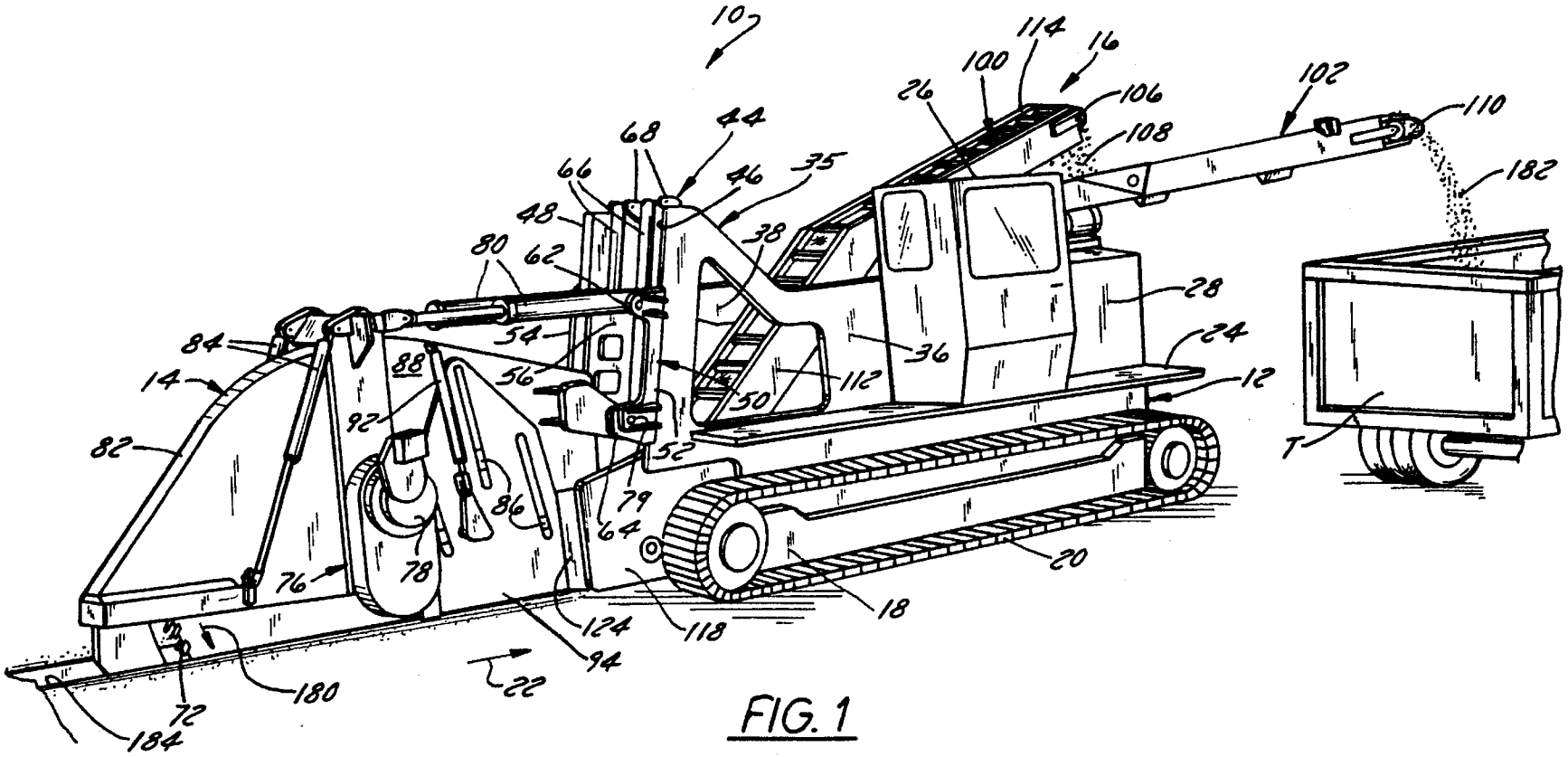
FIG. 1 is a perspective view of a rock saw-type excavating machine constructed in accordance with the preferred embodiment of the invention and illustrating the excavating machine in an operative position.
Figure 2:
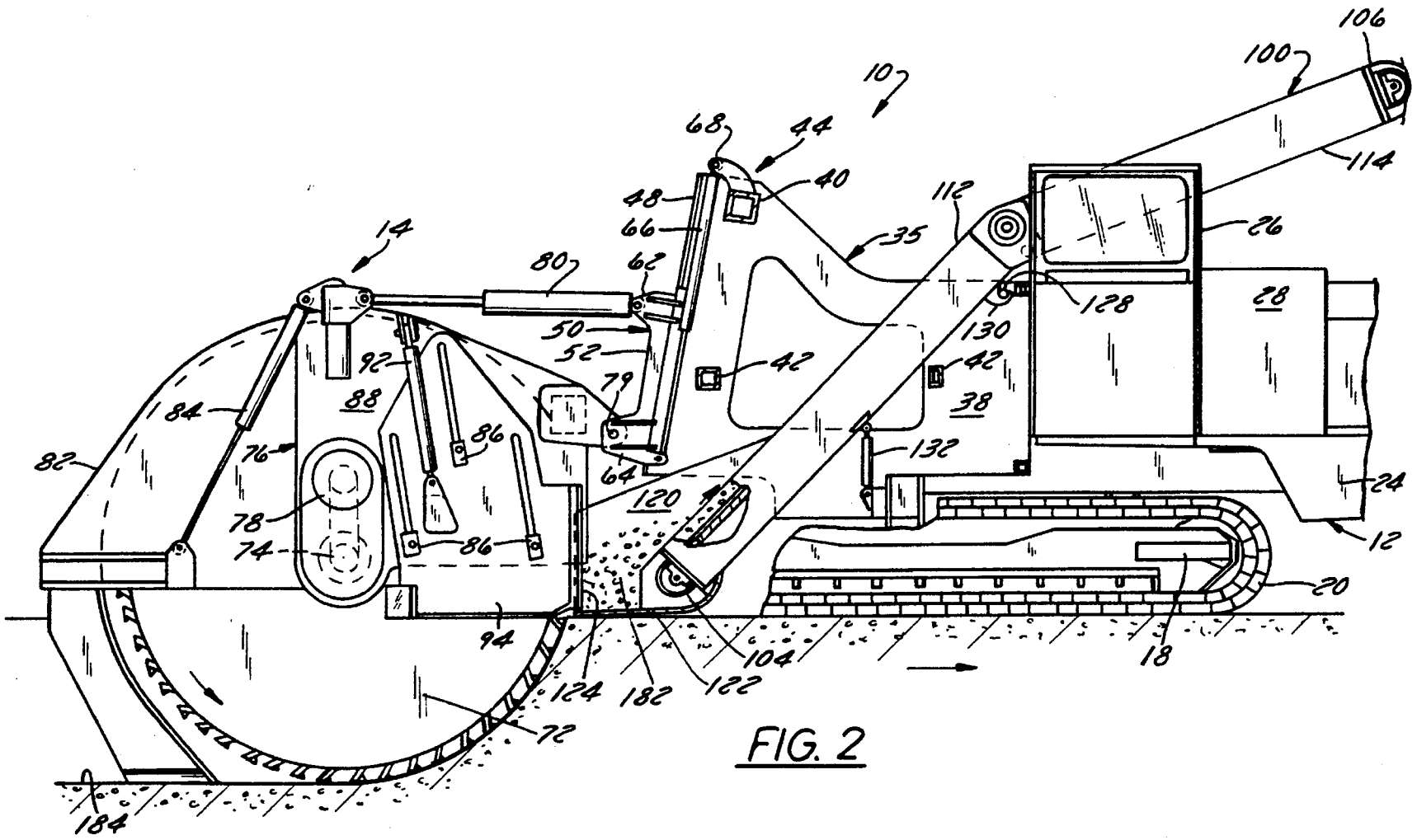
FIG. 2 is a partially cut away side elevation view of the excavating machine of FIG. 1.

Pursuant to the invention, a rock saw is provided having a cutting wheel and a conveyor assembly capable of retrieving automatically essentially all materials excavated by the cutting wheel and of discharging the retrieved materials into an adjacent truck or the like. The conveyor assembly includes a loading conveyor which is movable from a raised transport position to a lowered operative position. When in its operative position, an inlet end of the loading conveyor is positioned on the ground in a discharge region of the cutting wheel and is biased into engagement with the ground so as not to bounce up and down in operation but so as to ride over rocks and other obstructions without damaging the conveyor. The cutting wheel is both pivotable and slidable vertically with respect to the vehicle mainframe so as to be capable of cutting trenches of radically different depths while still assuring retrieval of essentially all excavated materials by the loading conveyor.

2. System Overview

Referring now to the drawings, a rock saw 10 constructed in accordance with the present invention is illustrated. Rock saw 10 includes a self-propelled vehicle 12, a rock saw assembly 14 mounted on and extending rearwardly from the longitudinal rear end of the vehicle 12, and a conveyor assembly 16 mounted on the vehicle 12. The vehicle 12 includes a chassis 18 mounted on tracks 20 for movement along the ground in a direction of travel indicated by the arrow 22 in FIG. 1. Mounted on the chassis 18 is a frame assembly 24 which receives an operator's cab 26 and an engine 28.

Figure 9:
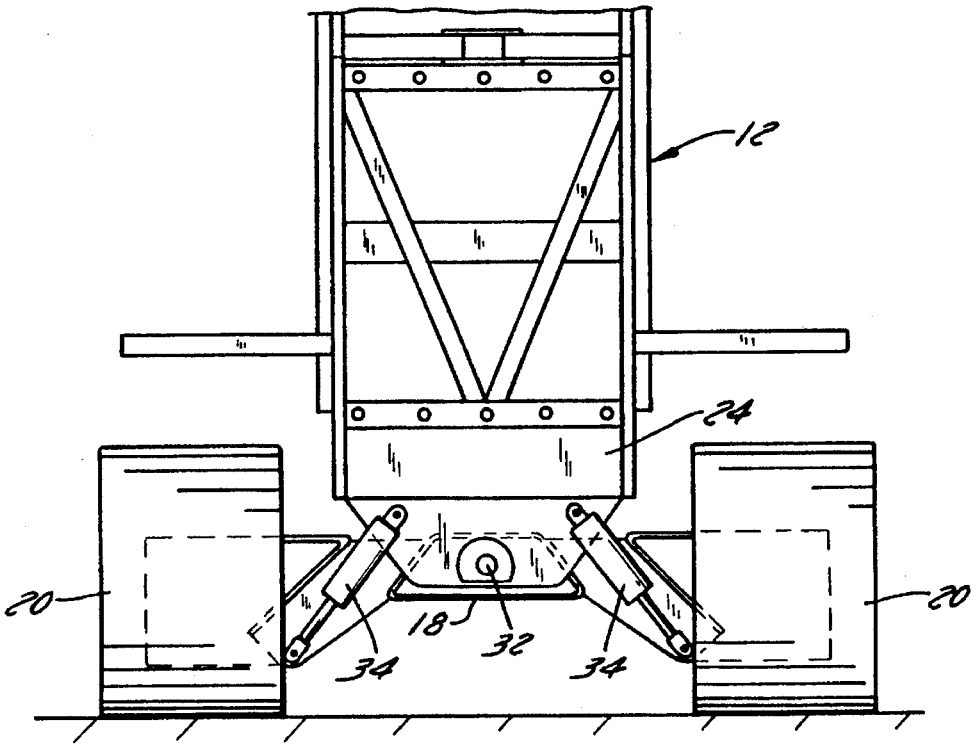
FIGS. 9 and 10 are partially schematic, partially cut away front elevation views illustrating the rocking of the frame assembly of the excavating machine about the chassis.
Figure 10:
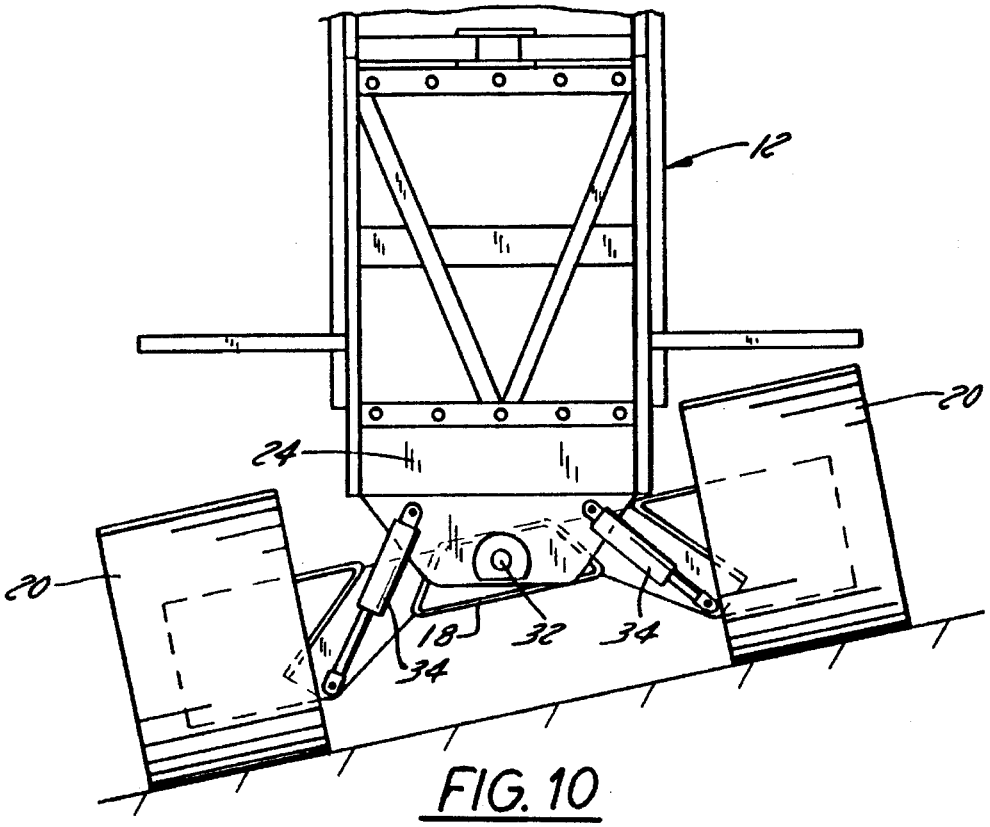

The frame assembly 24 is preferably modularized to permit the mounting of different digging implement, engine, conveyor, and cab configurations on the same chassis 18. In addition, referring to FIGS. 9 and 10, the frame assembly 24 is also preferably tiltably mounted on the chassis 18 to assure a vertical orientation of the rock saw assembly 14 and operator's cab 26 even when the vehicle 12 is travelling along a side hill incline. To this end, the frame assembly 24 is pivotally mounted on the chassis 18 at its front and rear ends by horizontal pivot shafts 30, 32 extending along the longitudinal centerline of the vehicle 12. A pair of double acting hydraulic cylinders 34 extend from respective lateral sides of the frame assembly 24 to the chassis 18 to tilt the frame assembly 24 laterally with respect to the chassis 18 as illustrated in FIG. 10, thus assuring a vertical orientation of the frame assembly 24.

Figure 6:
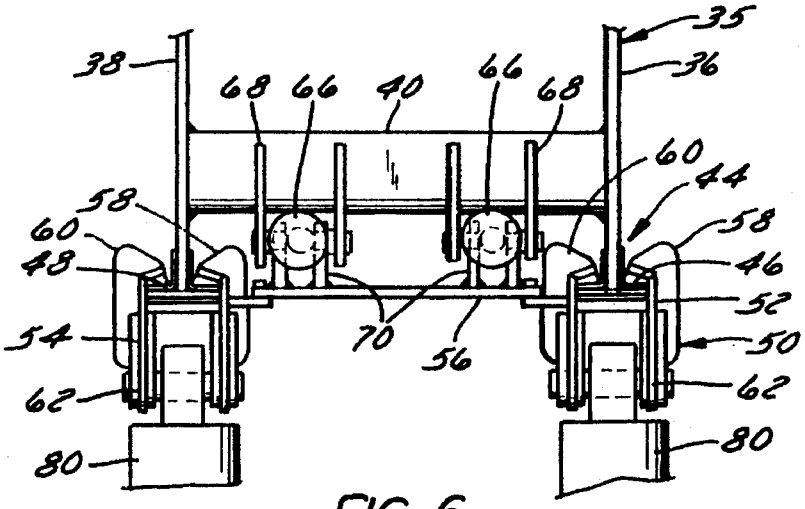
FIG. 6 is a top plan view of the assemblies illustrated in FIG. 5.
Figure 5:
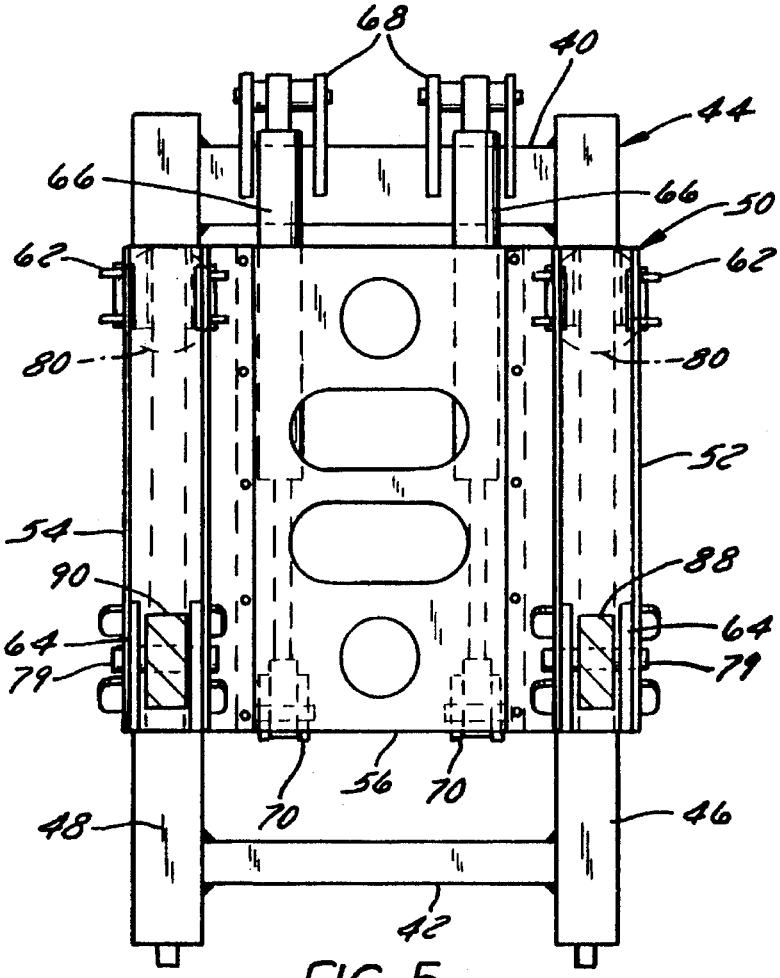
FIG. 5 is a rear elevation view of the carriage and mast assemblies of the excavating machine of FIGS. 1 through 4.
Figure 7:
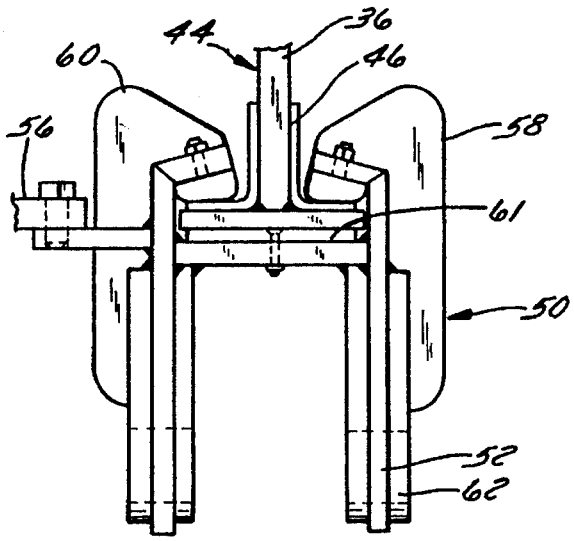
FIG. 7 is an enlarged fragmentary view of a portion of FIG. 6.

The rear end of the frame assembly 24 comprises a subframe 35 specially designed to accommodate the rock saw and conveyor assemblies 14 and 16. The subframe 35 includes a pair of laterally opposed, longitudinally extending side plates 36, 38 connected to one another by upper and lower cross braces 40, 42. A mast 44 is formed at the rear end of the subframe 35 and includes a pair of laterally opposed reinforced metal T-rails 46, 48 mounted on the longitudinal end of the side plates 36, (FIGS. 5–7).

A carriage 50 is mounted on the mast 44 for sliding movement along the T-rails 46, 48. Carriage 50 includes a pair of laterally opposed channel members 52, 54 extending in parallel with the T-rails 46, 48 and connected to one another by a center plate 56. Each of the channel members 52, 54 is slidably mounted on a respective one of the T-rails 46, 48 by a C-shaped portion 58, 60 (FIG. 7) presenting a transverse guide surface which slidably engages a from surface of a respective T-rail. The rear surface of each T-rail 46 or 48 slidably engages a wear plate 61 mounted (FIG. 7) on the front end of the respective channel member 52, 54. Extending rearwardly from the upper and lower ends of each of the channel members 52, 54 is an upper cylinder mount 62 and a lower housing mount 64 respectively. In addition, each of a pair of hydraulic cylinders 66 is pivotally connected at its upper end to a first ear mount 68 provided on the mast 44 and at its lower end to a second ear mount 70 provided on the plate 56 and is operable to selectively raise and lower the carriage 50 with respect to the mast 44.

3. Construction of Rock Saw Assembly

Figure 3:
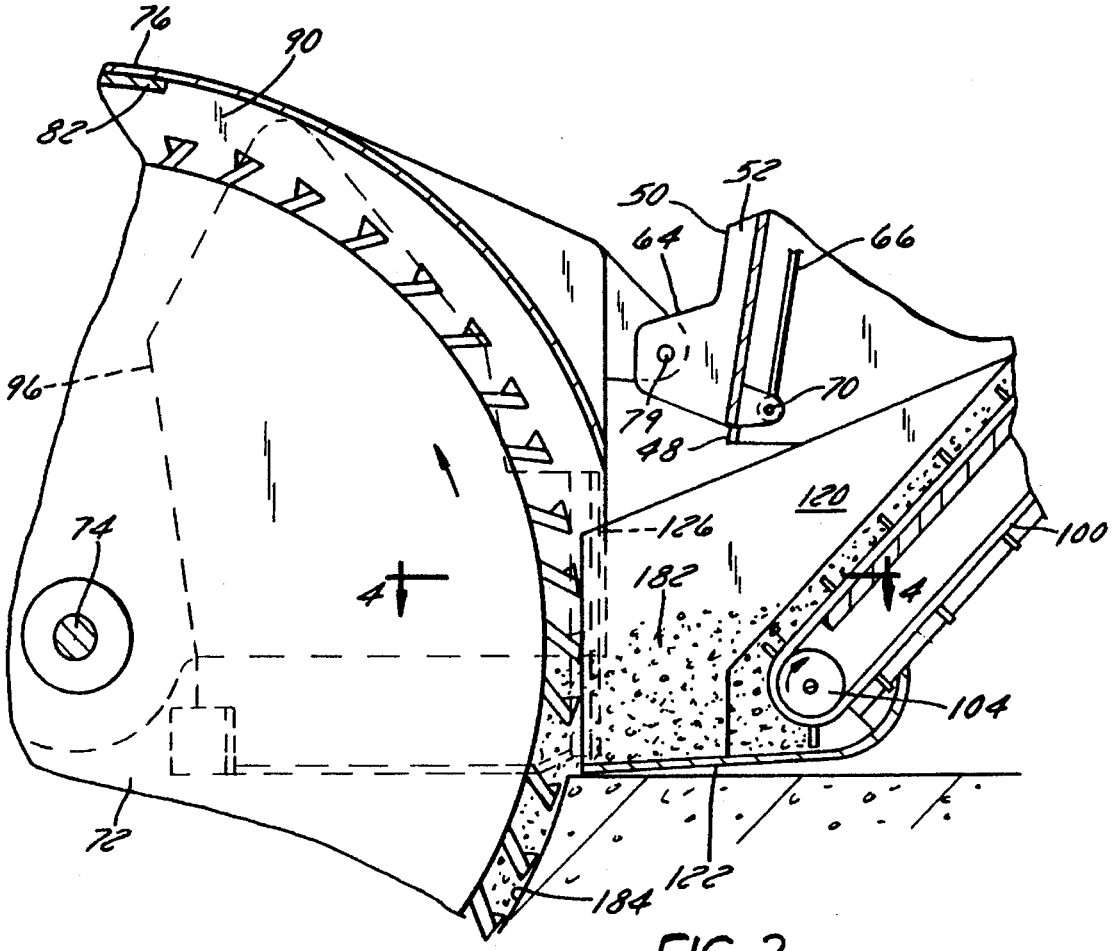
FIG. 3 is an enlarged fragmented view of a portion of the excavating machine illustrated in FIG. 2.

The rock saw assembly 14 comprises a carbide-tipped toothed cutting wheel 72 rotatably mounted in a housing 76 by a horizontal shaft 74. The cutting wheel 72 is driven to rotate by a hydrostatic motor 78 mounted on the exterior of the housing 76 and powered by engine 28. The cutting wheel 72 will typically have a diameter of about 96 inches and a width of anywhere from a few inches to about 2 feet. The housing 76 is pivotally mounted to the lower mounts 64 of the carriage 50 by a pivot shaft 79 (FIG. 3) and is pivoted about shaft 79 by a pair of hydraulic cylinders 80 each of which is connected to an upper portion of the housing 76 at its rod end and to one of the upper mourns 62 at its cylinder end. A rear shield 82, pivotable about the housing 76 via operation of hydraulic cylinders 84, preferably but not necessarily encases the rear end of the cutting wheel 72. Slide mourns 86 extend laterally from opposed side walls 88, 90 of the housing 76 and permit the cutting depth of the wheel 72 to be adjusted by activating a hydraulic cylinder 92 to raise and lower slotted guide plates 94, 96 along the side walls 88, 90.

It can thus be seen that the carriage 50 and the associated cylinders 66, 80 can be used to provide greater variation of rock saw orientation than would otherwise be possible while still assuring retrieval of essentially all excavated materials. The cutting depth of a cutting wheel traditionally was varied simply by pivoting the cutting wheel about a fixed pivot point. While this adjustment proved satisfactory, it hindered raising cutting wheels for transport. Moreover, as the traditional cutting wheel pivots with respect to a fixed axis, the point at which materials are discharged in front of the cutting wheel varies because its axis of rotation varies with respect to ground. This did not create a problem with traditional rock saws which did not attempt to retrieve excavated materials, but could be problematic in the present invention in which maintaining a constant relationship between the loading conveyor and the cutting wheel is of some importance. By combining the pivotal movement of the housing 76 about the carriage 50 with linear movement of the carriage 50 along the mast 44, this relationship can be maintained.

4. Construction of Conveyor Assembly

The conveyor assembly 16 is specially designed to receive excavated materials directly from the rock saw assembly 14 and to discharge essentially all excavated materials into a truck T, thereby leaving both the trench 184 and the adjacent areas free of debris. To this end, the conveyor assembly 16 extends within rather than to the side of the lateral confines of the vehicle 12 and has an inlet end located in the "discharge region" of the cutting wheel 72. ("Discharge region" as used herein means that area in which excavated materials are thrown upon rotation of the cutting wheel 72.) Ideally, the conveyor assembly 16 should be capable of performing this task through all available cutting depths of the rock saw assembly 14 and should also be movable from an operative position to a transport position.

To this end, the conveyor assembly 16 is a centerline conveyor assembly mounted on or near the longitudinal centerline of the vehicle 12 and having a rear loading conveyor 100 and a front discharge conveyor 102 independently mounted on the vehicle 12. Both the loading conveyor 100 and the discharge conveyor 102 are preferably hydrostatically-driven drag-slat conveyors the motors for which are powered by the engine 28. The loading conveyor 100 is pivotally mounted on the subframe 35 and is inclined upwardly and forwardly from a rear inlet end 104 (positioned in the discharge region) to a front discharge end 106 (positioned in the vicinity of the front end of the vehicle 12). The discharge conveyor 102 is slidably, pivotally, and rotatably mounted on the front end of the vehicle 12 and has an inlet end 108 and a discharge end 110.

Figure 4:
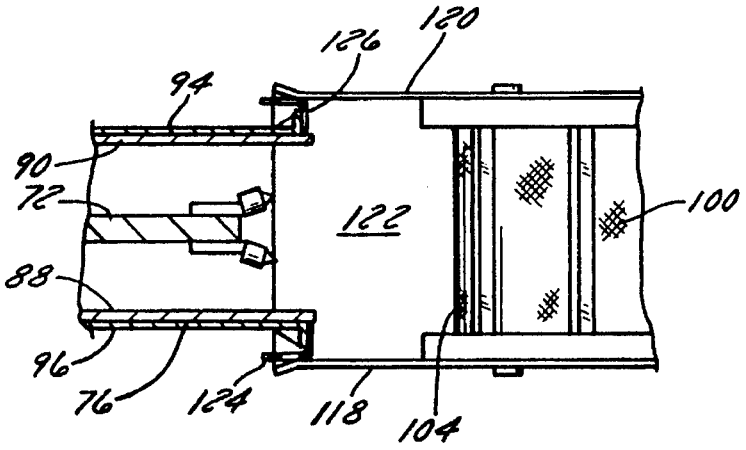
FIG. 4 is a sectional plan view taken along the lines 4—4 in FIG. 3.

The loading conveyor 100 includes a rear, steeply inclined loading portion 112 mounted on the subframe 35 and presenting the inlet end 104. Loading conveyor 100 further includes a front, more shallowly inclined discharge portion 114 extending forwardly from the front end of the loading portion 112 and presenting the discharge end 106. The inlet end 104 takes the form of a trough attached to the lower end of the conveyor proper and located in the discharge region of the cutting wheel 72 when the conveyor 100 is in its operative position. The trough 104 has a rear end located closely adjacent the cutting wheel 72, a pair of longitudinal side walls 118, 120, and a generally flat bottom 122 which rests on the ground when the conveyor 100 is in its operative position. Ideally, the trough 104 is somewhat wider than the cutting wheel housing 76 and extends to the rear of the front end of the housing 76 so that the front end of the housing 76 actually rides on top of the rear end of the trough 104 when the cutting wheel housing 76 is pivoted about the shaft 79 into its operative position, thus assuring that essentially all excavated materials are thrown directly into the trough 104. A rubber or plastic shield 124, 126 extends from each plate 94, 96 to the respective side wall 118, 120 of the trough 104 to prevent the escape of excavated materials through the spaces formed therebetween (FIG. 4).

Figure 8:
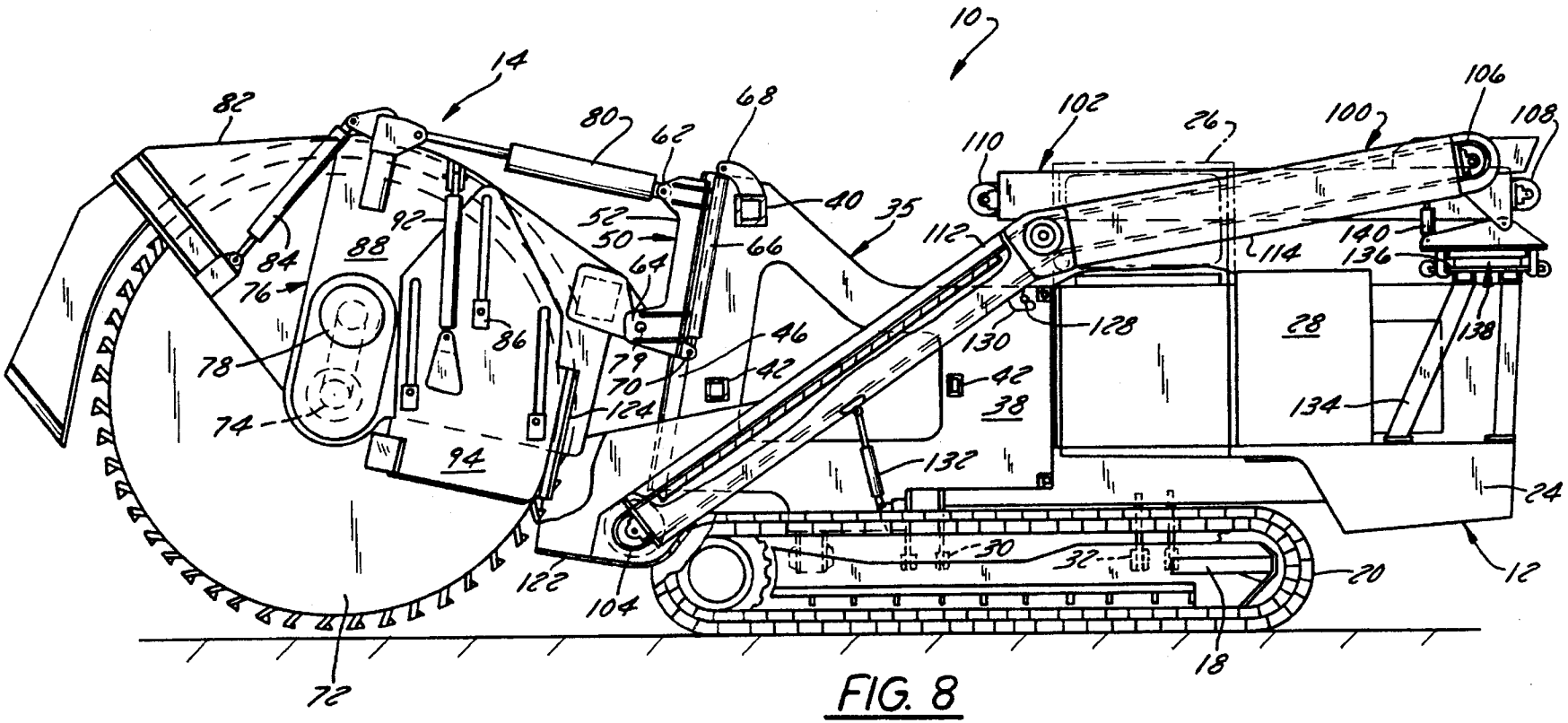
FIG. 8 is a partially cut away side elevation view of the excavating machine of FIGS. 1 through 3, illustrating the machine in a transport position.

The loading portion 112 of the loading conveyor 100 is pivotally mounted on the subframe assembly 35 so as to be raiseable and lowerable 1) to assure that the inlet end 104 rides on the ground as illustrated in FIGS. 1 through 4 when the rock saw 10 is operational and, 2) to permit the inlet end 104 to be raised off the ground as illustrated in FIG. 8 for transport. To this end, a pair of opposed pivot mounts 128 (FIGS. 2 and 8) extend outwardly from the side plates 36, 38 of the subframe 35 and receive pivot brackets 130 depending from the loading portion 112. A corresponding pair of double acting hydraulic cylinders 132 are positioned longitudinally between the pivot mounts 128 and the inlet end 104 and are pivotally connected at their rod ends to the loading conveyor 100 and at their cylinder ends to the subframe 35. Accordingly, extension or retraction of the cylinders 132 pivots the loading conveyor 100 about the pivot mounts 128, thereby raising or lowering the inlet end 104 and simultaneously lowering or raising the discharge end 106.

The discharge conveyor 102 preferably is designed to be moveable from an operative position in which the inlet end 108 thereof is positioned directly under the longitudinal centerline of the loading conveyor 100 to a stored or transport position in which the entire discharge conveyor 102 is maintained substantially within the dimensional confines of the vehicle 12. The discharge conveyor 102 is also designed to swing from side to side when in its operative position so as to permit the discharge of excavated materials from the discharge end 110 thereof into a truck T located either in front of or equidistantly to either side of the vehicle 12. To this end, the discharge conveyor 102 is mounted on the frame assembly 24 by a support assembly which includes a support frame 134, a slide 136, and a turntable assembly 138 (FIG. 8). The slide 136 permits the turntable assembly 138 and discharge conveyor 102 to move laterally (1) from the operative position illustrated in FIG. 1 in which the inlet end 108 of the discharge conveyor 102 is located directly underneath the discharge end 106 of the loading conveyor 100 (2) to the transport position illustrated in FIG. 8 in which the inlet end 108 of the discharge conveyor 102 is located laterally beside the discharge end 106 of the loading conveyor 100. The turntable assembly 138 is operable to swing the discharge end of the discharge conveyor 102 from side to side when in its operative position and, when the slide 136 is positioned as illustrated in FIG. 8, permits the discharge end 110 to rotate further to a location in which the discharge conveyor 102 extends substantially in parallel with the loading conveyor 100 and in which the discharge end 110 thereof is located between the inlet and discharge ends 104 and 106 of the loading conveyor 100. Finally, the discharge end 110 of the discharge conveyor 102 can be raised and lowered through suitable operation of a hydraulic cylinder 140 (FIG. 8).

The construction and operation of the turntable assembly 138 and slide 136 do not per se form part of the present invention. Moreover, it is believed that one skilled in the art could make and use a variety of devices capable of performing the stated functions based upon the description given above. Accordingly, these devices will not be described in greater detail. Any parties interested in the construction and operation of the preferred embodiments of these devices should refer to co-pending and commonly assigned Patent Application No. 08/456,185, entitled "Excavating Machine with Stowable Discharge Conveyor" and filed concurrently herewith. The subject matter of this co-pending patent application, believed non-essential to the present invention, is hereby incorporated by reference in its entirety.

5. Construction of Loading Conveyor Hydraulic Circuit

Figure 11:
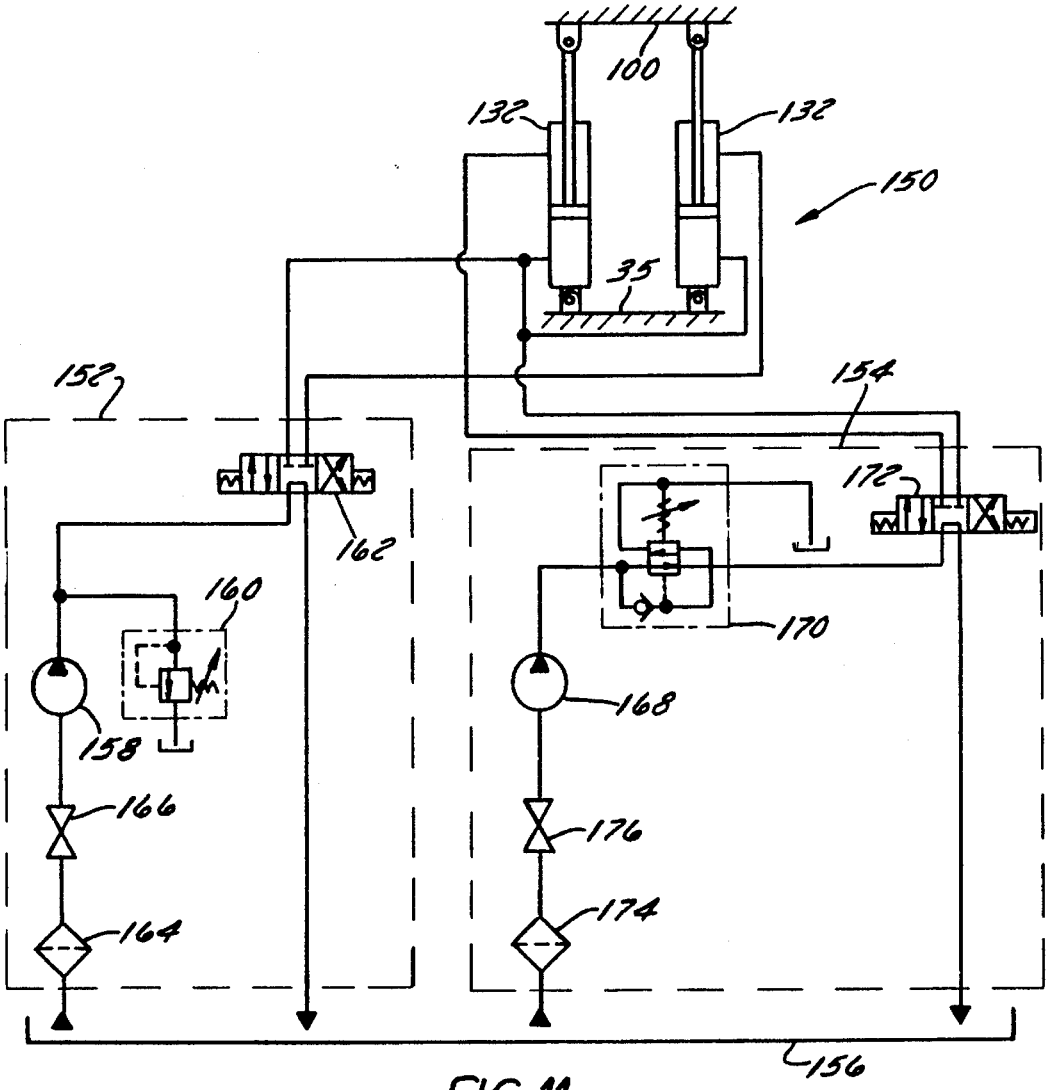
FIG. 11 diagrammatically represents a hydraulic circuit used to raise and lower the loading conveyor of the excavating machine of FIGS. 1 through 10.

As discussed above, the hydraulic cylinders 132 can be controlled to raise the inlet end 104 of the loading conveyor 100 from a lowered operative position to a raised transport position. The hydraulic cylinders 132 are also preferably operable to apply a designated downward biasing force to the inlet end 104 of the loading conveyor 100 when the inlet end 104 is in its operative position. This force should be sufficiently high to prevent the inlet end 104 from bouncing up and down during normal operation of the system, thereby assuring receipt and transport of essentially all excavated materials. However, this biasing force should also be sufficiently low to permit the inlet end 104 to ride over rocks and other obstructions, thereby preventing damage to the conveyor assembly 16. A hydraulic circuit 150 suitable for both of the tasks is illustrated in FIG. 11.

The circuit 150 includes a first circuit portion 152 designed to raise the inlet end from its lowered operative to its raised transport position and to maintain the loading conveyor 100 in its raised position for transport, and a second circuit portion 154 designed to apply the downward biasing force to the inlet end 104 when the conveyor 100 is in its operative position. Both the first and second circuit portions 152 and 154 cooperate with a common tank or reservoir illustrated schematically at 156 in FIG. 11.

The first circuit portion 152 includes as its primary components a high pressure pump 158, a pressure reducing valve assembly 160, and a three-way/three position solenoid valve 162. The pump 158 has an inlet connected to the tank 156 via a filter 164 and a shut-off valve 166 and also has an outlet connected to the pressure reducing valve assembly 160 and valve 162. The output pressure of the pump 158 is limited by the pressure reducing valve assembly 160 to about 1,000 to 2,000 psi. This pressure is sufficiently high to raise the loading conveyor 100 into its transport position and to power other components of the system such as the remaining hydraulic cylinders and even one or more of the hydrostatic motors. The solenoid valve 162 has first through fourth ports connected to the pump 158, the tank 156, and to the rod end and cylinder end of the hydraulic cylinders 132, respectively.

The second circuit portion 154 includes a relatively low-output pressure pump 168, an adjustable pressure reducing valve assembly 170, and a solenoid valve 172. The pump 168 has an inlet connected to the tank 156 via a filter 174 and a shut-off valve 176 and also has an outlet connected to the pressure reducing valve assembly 170 and valve 172. The solenoid valve 172, like the valve 162 of the first circuit portion 152, has first through fourth ports connected to the outlet of pump 168, the tank 156, and to the rod and cylinder ends of the hydraulic cylinders 132, respectively. Although the illustrated valve 172 is a three-way/three-position valve, it in practice only switches from the illustrated neutral position to the left-most position illustrated in the drawing in which the rod ends of the cylinders 132 are pressurized and the cylinder ends are vented, thereby applying the desired downward biasing force to the inlet end 104 of the loading conveyor 100. This biasing force can be adjustable as required through suitable manipulation of the pressure reducing valve assembly 170.

6. System Operation

The rock saw 10 is normally maintained in a transport position by stowing the discharge conveyor 102 as discussed above and by completely retracting the cylinders 66, 80, and 132 to 1) raise the inlet end or trough 104 of the loading conveyor 100 off the ground, 2) raise the carriage 50 on the mast 44, and 3) pivot the rock saw housing 76 clockwise about the carriage 50 as illustrated in FIG. 8. The loading conveyor 100 is maintained in its raised position by maintaining both the valves 162 and 172 in the neutral position illustrated in FIG. 11.

To cut a trench 184, the loading conveyor 100 is lowered into is operative position by maintaining the valve 162 in its neutral position and by switching the valve 172 to the position venting the cylinder ends of hydraulic cylinders 132 and pressurizing the rod ends to a pressure on the order of 300 to 500 psi. As discussed above, this pressure applies biasing forces to the trough 104 which are sufficiently high to prevent the trough 104 from bouncing up and down during normal use but which are sufficiently low to permit the trough 104 to ride up and over rocks and other obstructions, thereby preventing damage to the conveyor 100. The discharge conveyor 102 then is moved on turntable assembly 138 and slide 136 to the position illustrated in FIG. 1 in which the inlet end 108 thereof is located directly under the discharge end 106 of the loading conveyor 100 and in which the discharge end 110 is suitably located for discharging materials into a truck T. The cylinders 66 and 80 are also extended to lower the carriage 50 on the mast 44 and to pivot the cutting wheel housing 76 counterclockwise about the carriage 50 to the position illustrated in FIGS. 1–3, thereby lowering the cutting wheel 72 into engagement with the ground. The cutting wheel 72 is then driven to rotate by the motor 78 in the direction of arrow 180 as the vehicle 12 travels in the direction of arrow 22, thereby digging the trench 184. Essentially all materials 182 excavated by the cutting wheel 72 are thrown into the trough 104, conveyed by the loading conveyor 100 upwardly and forwardly as viewed in the drawings, discharged into the discharge conveyor 102, and then discharged into truck T as illustrated in FIG. 1. Pivoting and sliding movement of the cutting wheel 72 with respect to the carriage 50 and mast 44 cooperate to maintain the desired spacial relationship between the trough 104 and the cutting wheel 72 as the cutting depth is adjusted.

To ready the rock saw 10 for transport, the operation described above is merely reversed. The discharge conveyor 102 hence is first moved laterally on slide 136 and then rotated on turntable assembly 138 into to its stowed position illustrated in FIG. 8. Then, the valve 172 is switched to its neutral position, and the valve 162 is switched to the position connecting the rod ends of the cylinders 132 to the tank 156 and the cylinder ends to the pump 158, thereby extending the cylinders 132 and pivoting the loading conveyor 100 about the pivot mounts 128 to raise the inlet end 104 thereof into its transport position illustrated in FIG. 8. The discharge end 106 lowers upon this pivoting to a location beneath the level of the inlet end 108 of the discharge conveyor 102. Next, the valve 162 is switched back to the neutral position illustrated in FIG. 11, thereby maintaining pressure in the cylinder ends of the cylinders 132 and holding the loading conveyor 100 in its transport position. During this time, the cylinders 66 and 80 are retracted to raise the carriage 50 on the mast 44 and to pivot the cutting wheel housing 76 about the carriage 50 back into the position illustrated in FIG. 8.

Many changes and modifications could be made to the invention without departing from the spirit thereof. For instance, the orientations and locations of the cylinders and pivot shafts for the loading conveyor could be reversed. Moreover, different mount assemblies for the cutting wheel could be employed, so long as some device is used to maintain the rotational axis for the cutting wheel relatively low to the ground in operation, thereby facilitating the discharge of excavating materials directly into the inlet trough of the loading conveyor. The scope of these and other modifications will become apparent in the appended claims.

We claim:

1. An excavating machine comprising:

(A) a portable chassis;

(B) a frame assembly mounted on said chassis and extending longitudinally with respect to said chassis, said frame assembly having a longitudinal end portion;

(C) a rock saw assembly mounted on said end portion of said frame assembly, said rock saw assembly comprising a rotary cutting wheel and, in use, being operable to dig a trench and to discharge materials into a discharge region located longitudinally adjacent said cutting wheel, said rock saw assembly being relatively narrow when compared to said frame assembly;

(D) a loading conveyor mounted on said frame assembly, said loading conveyor having an inlet end movable from a transport position in which said inlet end is located above the ground to an operative position in which said inlet end rides on the ground in said discharge region, wherein said loading conveyor includes a discharge end and is pivotally mounted on said frame assembly at a pivot axis located longitudinally between said inlet end and said discharge end; and (E) further comprising an actuator, mounted on said frame assembly and connected to said loading conveyor at a location between said inlet and discharge ends, which selectively pivots said loading conveyor about said pivot axis, thereby raising and lowering said inlet end.

2. An excavating machine as defined in claim 1, wherein said actuator comprises a hydraulic cylinder, and further comprising a pressure compensated hydraulic circuit which actuates said hydraulic cylinder to apply a designated downward biasing force to said inlet end of said loading conveyor when said inlet end is in said operative position.

3. An excavating machine as defined in claim 2, wherein said hydraulic circuit includes (1) a first circuit portion operable to supply a first pressure to a first end of said cylinder so as to lift said inlet end of said loading conveyor into said transport position and (2) a second circuit portion operable to supply a second pressure to a second end of said cylinder so as to hold said inlet end of said loading conveyor in said operative position, said second pressure being substantially less than said first pressure.

4. An excavating machine as defined in claim 3, wherein said second pressure is between 300 psi and 500 psi.

5. An excavating machine as defined in claim 1, further comprising a discharge conveyor extending from said discharge end of said loading conveyor to a position beyond the dimensional confines of said frame assembly.

6. An excavating machine comprising:

(A) a portable chassis;

(B) a frame assembly mounted on said chassis and extending longitudinally with respect to said chassis, said frame assembly having a longitudinal end portion;

(C) a rock saw assembly mounted on said end portion of said frame assembly, said rock saw assembly comprising a rotary cutting wheel and, in use, being operable to dig a trench and to discharge materials into a discharge region located longitudinally adjacent said cutting wheel, said rock saw assembly being relatively narrow when compared to said frame assembly; and (D) a loading conveyor mounted on said frame assembly, said loading conveyor having an inlet end movable from a transport position in which said inlet end is located above the ground to an operative position in which said inlet end rides on the ground in said discharge region, wherein said inlet end of said loading conveyor comprises a trough having an end located closely adjacent said cutting wheel, a pair of longitudinal sidewalls, and a generally flat bottom which rests on the ground when said inlet end is in said operative position.

7. An excavating machine as defined in claim 6, wherein said rock saw assembly further comprises a housing which encases at least an upper end portion of said cutting wheel and which has opposed longitudinal sidewalls, and further comprising a pair of shields, each of which extends from one of said longitudinal sidewalls of said trough to one of said longitudinal sidewalls of said housing.

8. An excavating machine comprising:

(A) a portable chassis;

(B) a frame assembly mounted on said chassis and extending longitudinally with respect to said chassis, said frame assembly having a longitudinal end portion;

(C) a rock saw assembly mounted on said end portion of said frame assembly, said rock saw assembly comprising a rotary cutting wheel and, in use, being operable to dig a trench and to discharge materials into a discharge region located longitudinally adjacent said cutting wheel, said rock saw assembly being relatively narrow when compared to said frame assembly;

(D) a loading conveyor mounted on said frame assembly, said loading conveyor having an inlet end movable from a transport position in which said inlet end is located above the ground to an operative position in which said inlet end rides on the ground in said discharge region; and a mast which is mounted on said frame assembly and a carriage which is mounted on said mast for rectilinear movement with respect thereto, and wherein said rock saw assembly is mounted on said carriage.

9. An excavating machine as defined in claim 8, wherein said rock saw assembly is pivotally mounted on said carriage, and further comprising an actuator connected to said carriage and to said rock saw assembly and operable to pivot said rock saw assembly about said carriage.

10. An excavating machine as defined in claim 8, wherein said mast comprises a pair of laterally spaced T-shaped rails and said carriage comprises a pair of laterally spaced C-shaped members slidably mounted on said T-shaped rails, and further comprising a hydraulic cylinder which is connected to said carriage and to said mast and which is operable to raise and lower said carriage with respect to said mast.

11. An excavating machine comprising:

(A) a portable chassis;

(B) a frame assembly mounted on said chassis and extending longitudinally of said chassis, said frame assembly having a rear end portion;

(C) a rock saw assembly mounted on said rear end portion of said frame assembly so as to be raiseable and lowerable as well as pivotable with respect thereto, said rock saw assembly comprising a rotary cutting wheel and, in use, being operable to dig a trench and to discharge materials into a discharge region located longitudinally in front of said cutting wheel, said rock saw assembly being located at a laterally medial portion of said excavating machine and having a width which is substantially less than a width of said frame assembly;

(D) a loading conveyor mounted on a lateral medial portion of said frame assembly longitudinally in front of said cutting wheel, said loading conveyor including an inlet end located adjacent said cutting wheel and a discharge end located remote from said cutting wheel, said loading conveyor being pivotally mounted on said frame assembly at a horizontal pivot axis located between said inlet end and said discharge end;

(E) a hydraulic cylinder which (1) is mounted on said frame assembly and connected to said loading conveyor at a location between said inlet and discharge ends, and (2) selectively pivots said loading conveyor about said pivot axis, thereby selectively lowering said inlet end from a transport position in which said inlet end is lifted off the ground to an operative in which said inlet end rides on the ground in said discharge region; and (F) a pressure compensated hydraulic circuit which includes (1) a first circuit portion operable to supply a first pressure to a first portion of said cylinder so as to lift said inlet end of said loading conveyor into said transport position and (2) a second circuit portion operable to supply a second pressure to a second end of said cylinder so as to bias said inlet end of said loading conveyor into said operative position, said second pressure being substantially less than said first pressure.

12. An excavating machine as defined in claim 11, wherein said inlet end of said loading conveyor comprises a trough having an open rear end located closely adjacent said cutting wheel, a pair of longitudinal sidewalls, and a generally flat bottom which rests on the ground when said inlet end is in said operative position, and wherein said rock saw assembly further comprises a housing which encases at least an upper front end portion of said cutting wheel and which has opposed longitudinal sidewalls, and further comprising a pair of shields, each of which extends from one of said longitudinal sidewalls of said trough to one of said longitudinal sidewalls of said housing when said inlet end of said loading conveyor is in said operative position.

13. An excavating machine as defined in claim 11, further comprising a mast fixed to said frame assembly, wherein said rock saw assembly is mounted on a carriage which is raiseable and lowerable on said mast, and wherein said mast comprises a pair of laterally spaced T-shaped rails and said carriage comprises a pair of laterally spaced C-shaped members slidably mounted on said T-shaped rails, and further comprising a hydraulic cylinder which is connected to said carriage and to said mast and which is operable to raise and lower said carriage with respect to said mast.

14. An excavating machine as defined in claim 11, wherein said second pressure is between 300 psi and 500 psi.

15. A method of digging a narrow trench in a hard surface, comprising:

(A) lowering an inlet end of a loading conveyor from a raised transport position to a lowered operative position in which said inlet end rides on the ground at a location closely adjacent and longitudinally in front of a rotary cutting wheel of a rock saw assembly, said loading conveyor and said rock saw assembly being mounted on a frame assembly;

(B) rotating said cutting wheel to dig said trench; then (C) discharging excavated materials directly from said cutting wheel onto said inlet end of said loading conveyor; then (D) conveying said excavated materials away from said rock saw assembly using said loading conveyor; and (E) when said inlet end of said loading conveyor is in said operative position, applying a downward biasing force to said inlet end of said loading conveyor which is sufficiently high to prevent said inlet end from bouncing up and down during normal operation but which is sufficiently low to permit said inlet end to follow the contour of the ground and to pass over obstructions without damaging said loading conveyor.

16. A method as defined in claim 15, wherein said lowering step comprises actuating a hydraulic cylinder to pivot said loading conveyor about a pivot axis.

17. A method as defined in claim 15, further comprising lowering said rock saw assembly from a raised transport position to a lowered operative position during said step (A), said step of lowering said rock saw assembly comprising lowering a carriage with respect to a mast on which said carriage is slidably mounted, and pivoting said rock saw about said carriage.

* * * * *